United States Patent [19]

Reif et al.

[11] 4,427,256

[45] Jan. 24, 1984

[54] HIGH VOLTAGE CABLE/CONNECTOR ASSEMBLY

[75] Inventors: Robert H. Reif, Groton; Francis H. Stites, Wayland, both of Mass.

[73] Assignee: GTE Products Corporation, Stamford, Conn.

[21] Appl. No.: 368,783

[22] Filed: Apr. 15, 1982

[51] Int. Cl.[3] ..... H01R 15/24; H01R 13/53

[52] U.S. Cl. ..... 339/143 C; 339/111

[58] Field of Search ..... 339/111, 143 C, 178 R, 339/178 E

[56] References Cited

U.S. PATENT DOCUMENTS

| | | | |
|---|---|---|---|
| 1,962,326 | 6/1934 | Randall | 339/111 |
| 2,490,596 | 12/1949 | Morris | 339/177 E |
| 2,906,809 | 9/1959 | Drenning | 339/177 E |
| 3,622,937 | 11/1971 | Bokshorn et al. | 339/111 X |
| 3,848,088 | 11/1974 | Bentz | 339/111 X |

*Primary Examiner*—Eugene F. Desmond

*Attorney, Agent, or Firm*—Peter Xiarhos; Fred Fisher

[57] ABSTRACT

A high voltage cable/connector assembly of an improved design for substantially minimizing or eliminating damaging corona and voltage arc-over effects. The assembly in accordance with the invention includes a high voltage cable having a cable shield (e.g., a braided shield), a high voltage metal connector secured to and surrounding a portion of the cable and in physical and electrical contact with the cable shield, and a metal horn-shaped corona shield connected in series with the metal connector and defining a cavity through which a portion of the cable, including a center conductor and a surrounding bare plastic dielectric, passes longitudinally. The corona shield serves to eliminate sharp edges or abrupt terminations in the vicinity of the cable shield, metal connector and corona shield so that corona discharge is effectively prevented. The portion of the cable passing through the corona shield is selected to have a length to place the termination of the center conductor of this portion at a distance from the corona shield for minimizing the possibility of voltage arc-over from the center conductor to the corona shield and any other metal parts of the assembly.

10 Claims, 2 Drawing Figures

HIGH VOLTAGE CABLE/CONNECTOR ASSEMBLY

FIELD OF THE INVENTION

The present invention relates to a cable/connector assembly and, more particularly, to a high voltage cable/connector assembly of an improved design for substantially minimizing or eliminating damaging corona and voltage arc-over effects.

The invention herein described was made in the course of a contract with the Department of the Air Force.

BACKGROUND OF THE INVENTION

A variety of high voltage cables are currently available for coupling high values of voltage, for example, several thousand volts, to a load. A common, commercially-available form of such a cable includes a metal central conductor (e.g., of copper) surrounded, in succession, by a low-loss plastic dielectric (in which the central conductor is embedded), a metal (e.g., copper) shield, and a plastic (e.g., vinyl) sheath or jacket. A high-voltage cable such as described can have a typical voltage rating of 11,000 volts RMS and a peak voltage of about 15,500 volts. However, commercially available high voltage metal connectors for use with cables as described above have, in the absence of special modifications to the cables, much lower voltage ratings than the cables themselves, typically 5000 volts peak. As a result, if a connector with a rated peak voltage of 5000 volts is used with a cable having a rated peak voltage of about 15,500 volts (or 11,000 volts RMS), there is substantial likelihood or possibility that the connector will be destroyed or otherwise rendered ineffective because of damaging corona discharge and voltage arc-over effects. As is well known, the corona discharge effect manifests itself by a hot, bluish-purple glow appearing on the surface of and adjacent to the dielectric of the cable when the voltage gradient between the dielectric and the associated connector exceeds a certain critical value. The voltage arcing problem results from the existence of a small gap or space created by joining the dielectric with the dielectric of a mating (external) connector. In this case, large voltages carried by the cable are able to jump or arc over from the center conductor by way of the dielectric joint to the metal of the associated connectors. The corona and arc-over effects as described hereinabove have, in some instances, been avoided or alleviated by connecting the cable, absent a connector, to a load and, immersing the electrical connection within an oil or sulfur hexafluoride-filled container. In other instances, because of the potential damage to cables and connectors, cables have been employed without any connectors whatsoever.

BRIEF SUMMARY OF THE INVENTION

In accordance with the present invention, a cable/connector assembly is provided which avoids the problems associated with prior art cable/connector assemblies as discussed hereinabove.

The cable/connector assembly in accordance with the present invention generally includes an elongated high voltage cable, a high voltage metal connector, and a metal corona shield. The high voltage cable includes an electrically-conductive central conductor for receiving high-valued voltages, a continuous plastic dielectric surrounding the central conductor, and an electrically-conductive cable shield surrounding the dielectric for a portion of the length of the cable whereby the remainder of the dielectric is bare.

The high voltage metal connector and the metal corona shield as employed in the invention are arranged serially with each other and positioned in surrounding relationship with the cable with the portion of the cable having the bare dielectric extending longitudinally through and beyond the corona shield for a distance for minimizing the possibility of voltage arc-over between the central conductor of the cable and the corona shield. The metal connector is secured to the cable and is also in physical and electrical contact with the cable shield. The corona shield is in physical and electrical contact with the metal connector and includes a portion of a horn-like configuration directed upwardly and outwardly away from the metal connector and defining a cavity through which the aforesaid bare dielectric portion of the cable passes and extends longitudinally beyond the corona shield.

DETAILED DESCRIPTION OF THE INVENTION

Figure 1:
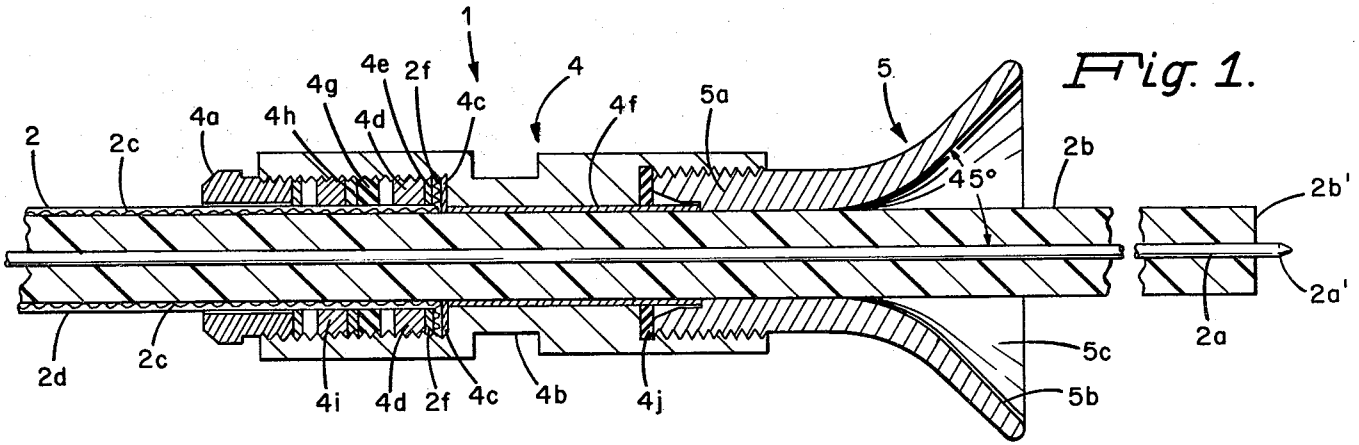
FIG. 1 is a cross-sectional view of a high voltage cable/connector assembly in accordance with the present invention.

Referring now to FIG. 1, there is shown a high voltage cable/connector assembly 1 in accordance with the present invention. The high voltage cable/connector assembly 1 as shown in FIG. 1 generally includes an elongated high voltage cable 2, a metal high voltage connector 4 secured to the cable 2, and a metal corona shield 5 secured to the connector 4 and in series therewith. The high voltage cable 2 is of a standard commercially-available design, for example, of a type known in the trade by the designation RG-17, and includes an electrically-conductive metal center conductor *2a*, a low-loss plastic dielectric *2b* in which the conductor *2a* is embedded, an electrically-conductive, metal, braided cable outer shield *2c* surrounding the dielectric *2b* for a major portion of the length of the cable 2, and a plastic outer sheath or jacket *2d* covering the cable shield *2c*. The center conductor *2a* and the shield *2c* are generally of copper, and the dielectric *2b* may variously be of polyethylene, "Teflon" (polytetrafluoroethylene) or "Rexolite" (polystyrene). The outer jacket *2d* is typically of an insulative material such as vinyl plastic. The cable 2 has a typical diameter of about 0.87 inch and has a rated voltage of 11,000 volts RMS and 15,500 volts peak.

The high voltage metal connector 4 as employed with the cable 2 is also of a standard, commercially-available design, a suitable implementation therefor being a so-called "straight plug" coaxial connector as is available from the Amphenol Corporation, Danbury, Conn., and designed for use with a cable of the aforementioned designation RG-17. Such a "straight plug" coaxial connector is shown and described in detail in Catalog CC-7, Amphenol RF Division.

The "straight plug" connector 4 as shown in FIG. 1 generally comprises an armor nut *4a* surrounding the cable 2, and a body element 4*b* also surrounding the cable 2 and threadably secured at opposite ends thereof to the armor nut 4*a* and to the aforementioned corona shield 5, as indicated in FIG. 1. The body element 4*b* is also secured to the cable 2 by way of a metal clamp 4*c* which "bites" circumferentially into the plastic dielectric 2*b* and which, in cooperation with a threaded metal spanner nut 4*d*, captures a small portion 2*f* of the braided shield 2*c* between itself and a metal washer 4*e*. The body element 4*b* further includes an electrical connector sleeve element 4*f* surrounding the cable 2 and in physical and electrical contact with both the metal braided shield 2*c* and the corona shield 5. The body element 4*b* also includes standard components including a rubber insulating gasket 4*g*, a metal washer 4*h*, a threaded metal spanner nut 4*i* threaded against the washer 4*h* and the gasket 4*g*, and another rubber gasket 4*j* in abutment with the corona shield 5.

Figure 2:
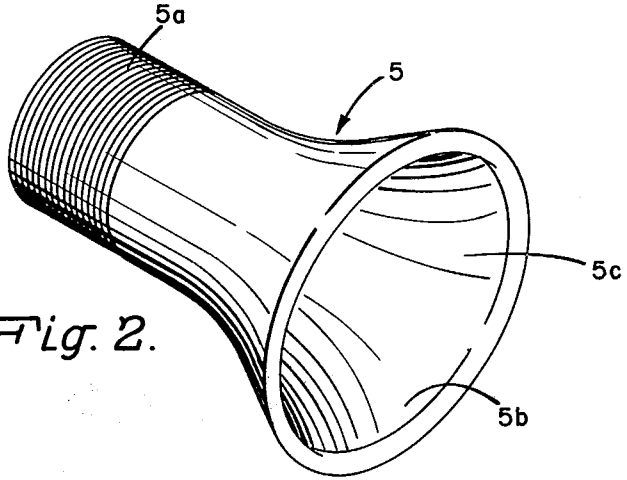
FIG. 2 is a perspective view illustrating a corona shield employed in the high voltage cable/connector assembly of FIG. 1.

In accordance with the present invention, the potentially damaging effects of corona discharge are effectively eliminated or minimized in the assembly 1 by the utilization of the aforementioned corona shield 5. The corona shield 5, which is shown in perspective view in FIG. 2, includes a threaded central body portion 5*a* connected with the body element 4*b* of the connector 4, and an outwardly-flaring, horn-like portion 5*b* of generally circular cross section integral with the body portion 5*a* and defining a funnel-shaped cavity 5*c*. The corona shield 5, which may be of a metal such as aluminum or brass, serves to establish a smooth, continuous transition from the braided shield 2*c* of the cable 2 (by way of the associated sleeve connector element 4*f* of the connector 4) so that no sharp edges or abrupt terminations exist in the vicinity of the shield 2*c*, the connector sleeve element 4*f*, and the dielectric 2*b* to establish voltage gradients at these areas sufficient to cause ionization of the surrounding air and, thus, corona discharge. Suitable dimensions for the corona shield 5 for achieving the above results are a length of about 3 inches, a diameter (maximum) of about 3 inches for the portion 5*b*, and a flare angle of about 45°.

The potentially damaging effects of voltage arc-over are also effectively eliminated or minimized in accordance with the present invention by arranging the cable 2 relative to the other components of the assembly 1 such that a substantial length of the cable 2, for example, about six inches, extends outwardly from the end of the connector 4, and through and past the corona shield 5. This latter extension of the cable 2 lacks the braided shield 2*c* and jacket 2*d* as utilized by the rest of the cable 2, and serves to place the termination of the central conductor 2*a* of the cable 2, designated 2*a*′ in FIG. 1, a substantial distance away from the corona shield 5 and any other metal surfaces, thereby minimizing or eliminating the potential or an arc being struck between the conductor portion 2*a*′ and the shield 5 or other metal surfaces. The remote location of the exposed end surface of the dielectric 2*b*, designated, 2*b*′ in FIG. 1, also serves to reduce or eliminate the potential for corona discharge by further eliminating abrupt terminations between the metal components of the assembly 1 and the dielectric 2*b*. The continuous, unbroken nature of the dielectric 2*b* of the cable 2 further acts to eliminate gaps or spaces at which voltages carried on the cable 2 are able to arc-over to metal parts.

The end 2*a*′ of the conductor 2*a* of the cable 2 may be connected in any suitable manner (e.g., by way of a spring-loaded jack) to a load (not shown) for supplying high-valued voltages to the load.

The various components of the cable/connector assembly 1 as described hereinabove are readily connected and disconnected from each other without the requirement of special tools. Further, the high voltage performance of the assembly is not severely limited by low atmospheric pressure as might be experienced, for example, in aircraft at altitudes of up to 35,000 feet.

While there has been described what is considered to be a preferred embodiment of the invention, it will be obvious to those skilled in the art that various changes and modifications may be made therein without departing from the invention as called for in the appended claims.

What is claimed is:

1. A cable/connector assembly comprising:

an elongated high voltage cable including an electrically-conductive central conductor for receiving high-valued voltages, a continuous plastic dielectric surrounding the central conductor, and an electrically-conductive cable shield surrounding the dielectric for a portion of the length of the cable whereby the remainder of the dielectric is bare; and a high voltage metal connector and metal corona shield arranged serially with each other and positioned in surrounding relationship with the cable with the portion of the cable having the bare dielectric extending longitudinally through and beyond the corona shield for a distance for minimizing the possibility of voltage arc-over between the central conductor of the cable and the corona shield;

said metal connector being secured to the cable and in physical and electrical contact with the cable shield; and said corona shield being in physical and electrical contact with the metal connector and including a portion of a horn-like configuration directed upwardly and outwardly away from the metal connector and defining a cavity through which the aforesaid bare dielectric portion of the cable passes and extends longitudinally beyond the corona shield.

2. A cable/connector assembly in accordance with claim 1 wherein:

the metal connector and the corona shield are threadably secured to each other.

3. A cable/connector assembly in accordance with claim 1 wherein:

the horn-like portion of the corona shield flares upwardly and outwardly at a flare angle of approximately 45° with respect to the central conductor of the cable.

4. A cable/connector assembly in accordance with claim 3 wherein:

the horn-like portion has a generally circular cross section.

5. A cable/connector assembly in accordance with claim 2 wherein:

the metal connector includes means physically attached to the dielectric of the cable and to the cable shield for physically securing the connector to the cable.

6. A cable/connector assembly in accordance with claim 5 wherein:

the cable further comprises a jacket of an insulative material surrounding the cable shield.

7. A cable/connector assembly in accordance with claim 6 wherein:

the connector includes an electrically-conductive metal sleeve between and in electrical contact with the cable shield and the corona shield.

8. A cable/connector assembly in accordance with claim 7 wherein:

the metal connector and the corona shield are threadably secured to each other.

9. A cable/connector assembly in accordance with claim 8 wherein:

the horn-like portion of the corona shield flares upwardly and outwardly at a flare angle of approximately 45° with respect to the central conductor of the cable.

10. A cable/connector assembly in accordance with claim 9 wherein:

the horn-like portion has a generally circular cross section.

* * * * *